United States Patent [19]

Bodle et al.

[11] Patent Number: 4,632,731

[45] Date of Patent: Dec. 30, 1986

[54] CARBONIZATION AND DEWATERING PROCESS

[75] Inventors: William W. Bodle, Deerfield; Francis S. Lau, Downers Grove; Michael C. Mensinger, Darien, all of Ill.

[73] Assignee: Institute of Gas Technology, Chicago, Ill.

[21] Appl. No.: 748,978

[22] Filed: Jun. 26, 1985

[51] Int. Cl.[4] ..... C10F 5/04; C10F 5/06

[52] U.S. Cl. ..... 201/4; 201/14; 201/25; 201/29; 201/31; 44/1 F; 44/10 A; 44/10 E; 44/10 K; 44/33

[58] Field of Search ..... 201/2.5, 4, 14, 25, 201/29, 31; 44/1 F, 16, 10 A, 10 D, 10 E, 10 K, 33

[56] References Cited

U.S. PATENT DOCUMENTS

| | | | |
|---|---|---|---|
| 1,122,474 | 12/1914 | Butterfield | 201/2.5 |
| 3,660,245 | 5/1972 | Zelnik et al. | 201/25 |
| 3,671,402 | 6/1972 | Wenzel et al. | 201/31 |
| 3,671,403 | 6/1972 | Hess et al. | 201/25 |
| 3,938,965 | 2/1976 | Pyle | 44/1 F |
| 3,971,704 | 7/1976 | Klenck et al. | 201/29 |
| 4,153,427 | 5/1979 | Bissett et al. | 48/86 R |
| 4,363,636 | 12/1982 | Bouvet et al. | 44/10 E |

FOREIGN PATENT DOCUMENTS

| | | | |
|---|---|---|---|
| 143105 | 5/1985 | European Pat. Off. | 44/33 |
| 739241 | 6/1980 | U.S.S.R. | 44/33 |

*Primary Examiner*—David L. Lacey

*Attorney, Agent, or Firm*—Thomas W. Speckman

[57] ABSTRACT

An energy efficient process for beneficiating and dewatering high water content carbonaceous materials utilizing a pneumatic stream to entrain, transport, dewater and to carbonize organic carbonaceous material in a fluidized bed. The process utilizes physical separation for principal removal of moisture and reduces contact between organic carbonaceous matter and hot process water, thereby retaining a high organic content in the product fuel. The organic carbonaceous materials are chemically beneficiated during carbonization in a fluidized bed contactor. Heat exchange and heat recovery procedures provide an economical, energy efficient process.

18 Claims, 1 Drawing Figure

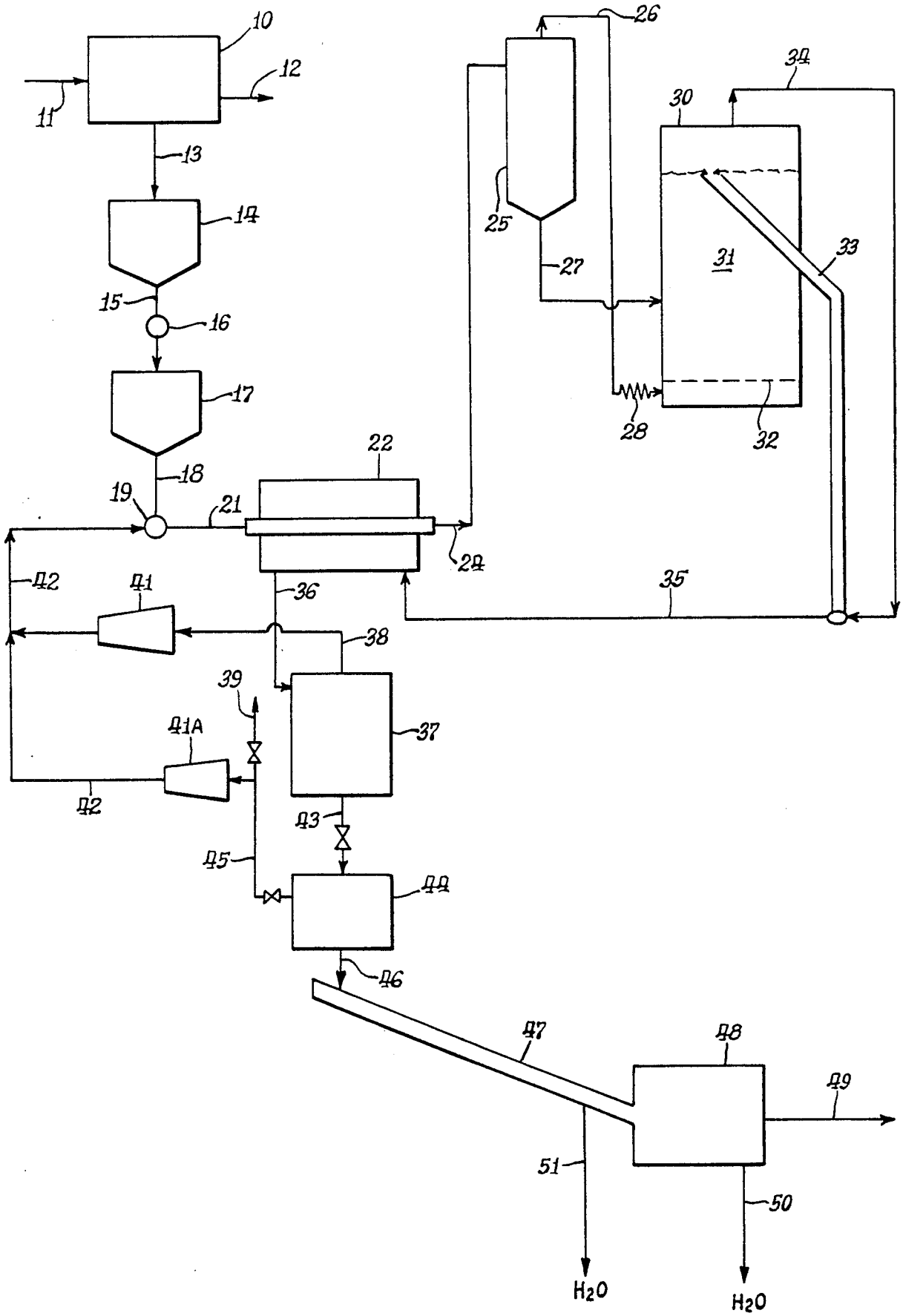
10
11
12
13
14
15
16
17
18
19
21
22
24
25
26
27
28
30
31
32
33
34
35
36
37
38
39
Д1
Д1А
Д2
Д2
Д3
Д4
Д5
Д6
Д7
Д8
Д9
50
51
H2O
H2O

CARBONIZATION AND DEWATERING PROCESS

BACKGROUND OF THE INVENTION

1. Field of the Invention

This invention relates to an improved, energy efficient and environmentally attractive process for beneficiating and dewatering high water content carbonaceous materials by a "dry" carbonization process to yield a superior fuel or intermediate product for further conversion.

2. Description of the Prior Art

The declining availability of petroleum based products as energy resources has spurred research efforts to provide alternative fuel resources. Most organic carbonaceous materials can be converted to a form which can be utilized as fuel, but conversion efficiencies and overall process efficiencies are undesirably low. The development of viable alternative energy sources depends to a large extent upon the development of energy efficient conversion processes.

Abundant and inexpensive organic carbonaceous raw materials, such as peat, lignite, kelp, mulch, and other biomass materials may be carbonized and dewatered to provide fuel. These materials, in their naturally occurring states, contain substantial amounts of water. For example, raw peat may comprise as much as 90 weight percent water. The bulk of the water must be removed from these organic carbonaceous materials before they can be utilized as a source of energy. Several water removal methods are known to the art.

Water removal has been accomplished by mechanical means, such as roller and belt presses or screening devices. Water removal by mechanical means alone, however, is inadequate. Peat, for example, may be mechanically dewatered to reduce the moisture content to about 65 to 75 weight percent. To achieve the desired final moisture content, usually 50 weight percent moisture or less, mechanically dewatered organic carbonaceous material ordinarily must be thermally dried. Thermal drying requires substantial energy inputs which render the process of mechanical dewatering in combination with thermal drying economically unattractive.

Solar energy may be utilized to air dry organic carbonaceous material to achieve a moisture content of less than 50 weight percent. This dewatering procedure is energy efficient, but its success is wholly weather dependent, and it requires continuous harvesting of large land areas. Utilization of solar energy to air dry organic carbonaceous material is not presently commercially viable.

Various pretreatment methods have been developed to facilitate the mechanical dewatering of organic carbonaceous materials to achieve a lower final moisture content. The pretreatment processes can be categorized as mechanical, biological and thermal. Mechanical pretreatment techniques are designed to remove colloidal matter prior to mechanical dewatering. Biological pretreatment effects limited biodegradation of organic carbonaceous materials and may also improve dewaterability, but the results of biological pretreatment are not well documented.

Thermal pretreatment methods which facilitate mechanical dewatering are generally referred to as wet carbonization processes. Typically, wet carbonization entails heating the organic carbonaceous material to temperatures of about 300° to about 1000° F. at pressures of about 300 to about 2000 psi, or even higher to prevent vaporization of water, for residence times of about one hour or less. Chemical decarboxylation and dehydration reactions occur during wet carbonization that permit more effective mechanical dewatering and enhance the heating value of the dewatered solids. Several wet carbonization processes are reviewed in Mensinger, Michael C., "Wet Carbonization of Peat; State of the Art Review", *Peat as an Energy Alternative Symposium Papers,* published by the Institute of Gas Technology, Chicago, Ill., September 1981, pp. 249-280. All of the systems reviewed in this paper employ water slurry transport systems imposing a large heat transfer load to the process and extraction of desired carbonaceous materials from the feed to the water slurry.

U.S. Pat. Nos. 2,624,712 and 4,268,417 teach processes for converting organic carbonaceous materials to activated carbon. The U.S. Pat. No. 2,624,712 patent teaches conversion of tars and pitches by solvent extraction and the U.S. Pat. No. 4,268,417 patent teaches conversion of coal using a water slurry followed by physical separation prior to heat treatment.

Pneumatic transport of pulverized fuel is known to the art, and is disclosed in U.S. Pat. No. 1,203,703. U.S. Pat. No. 4,153,427 teaches a method for feeding coal to a gasifier wherein an aqueous coal slurry is pressurized and then dried by contacting the slurry with superheated steam in an entrained bed drier prior to feeding coal particles to the gasifier. U.S. Pat. No. 4,363,636 discloses a method for converting raw bagasse to a usable fuel energy source by drying with hot flue gases, classifying by particle size, and densifying to pellet form to provide usable fuel.

SUMMARY OF THE INVENTION

The process of the present invention utilizes a pneumatic stream to entrain, transport, dewater and carbonize organic carbonaceous material in a fluidized bed. Conventional wet carbonization systems utilize water slurry systems to transport organic material through heating and carbonization equipment. Wet carbonization subjects organic carbonaceous material to continuous contact with large quantities of hot water for extended time periods. Substantial amounts of organic components are thus extracted to the aqueous phase, and the carbonized fuel has a concomitantly lower organic content. Additionally, dissolved organic matter must be removed from the aqueous phase before water can be recirculated or discharged.

The pneumatic stream used in the process of this invention provides a superior method for transporting and for drying organic carbonaceous material having a high moisture content. The process of this invention utilizes physical separation for principal removal of moisture and reduces contact between organic carbonaceous matter and hot process water. The organic content of the product fuel remains high and the amount of waste water produced is significantly lower than conventional wet carbonization processes, thus reducing the cost of waste water treatment. In addition, the costly and extensive heat exchange equipment needed for conventional slurry-fed wet carbonization is not required in the process of this invention. The improved process of this invention utilizes smaller, simpler heat exchange and heat recovery procedures to provide an economical, energy efficient process.

Any organic carbonaceous material which has a high inherent moisture content may be treated according to the dewatering and beneficiating process of this invention. Such high moisture content organic carbonaceous materials may include peat, lignite, kelp, bagasse, mulch, municipal sludge, and other biomass and organic waste materials.

High moisture content organic carbonaceous feed material having a moisture content in excess of about 80 weight percent is first dewatered by mechanical means such as screening, pressing and/or filtering to reduce the moisture content to about 65 to about 75 weight percent. When the feed material moisture content is in the range of about 75 weight percent or less, no such pre-dewatering treatment is required. The reduced moisture content feed is then conveyed to an elevated pressure system by means of a lockhopper system, a screw feeder, or other suitable transfer means known to the art and suitable for the pressures involved. Suitable pressures in the elevated pressure portion of the process of this invention are about 300 to about 600 psia, preferably about 400 to about 550 psia.

Solids are conveyed through the pressurized portion of the process by pneumatic transport using a circulating gas stream. The circulating gas stream may comprise any gas or mixture of gases in which the organic carbonaceous solids remain suspended, and which will not react adversely with the solids being treated. The circulating gas stream may also serve as fluidizing gas in a fluidized bed carbonization zone wherein organic carbonaceous material is carbonized. A preferred circulating gas which is suitable for use in the process of this invention comprises pressurized carbon dioxide and steam.

In a preferred embodiment, carbonaceous feed having a reduced moisture content due to mechanical dewatering may be passed in indirect countercurrent heat exchange relation to hot, carbonized solids discharged from a fluidized bed carbonizer. The carbonaceous feed may be preheated to about 300° to about 400° F. in the countercurrent heat exchanger, while carbonized organic solids are cooled. Preheated carbonaceous solids may then be pneumatically transported to a solids/gas separator. Separated gas is passed to a heater wherein the gas is heated to about 670° to about 730° F., preferably about 690° to about 710° F. for use as fluidizing and heating gas in the fluidized bed carbonizer. The gas temperature required will depend upon the composition of the fluidizing gas and the type of organic carbonaceous solids being carbonized. Heated fluidizing gas is introduced beneath the bed support grid of a fluidized bed contactor wherein organic carbonaceous solids are carbonized by contact with hot fluidizing gas.

Preheated organic carbonaceous solids, separated from the transporting gas stream, may be introduced into the fluidized bed and fluidized in the bed. Residence in the fluidized bed for about 1 to about 30 minutes, preferably about 15 to about 25 minutes, results in removal from the organic carbonaceous material of chemically bound oxygen as carbon dioxide and alters the structure of the organic solids enabling higher moisture removal by mechanical means. The most advantageous retention time of organic carbonaceous solids in the fluidized bed contactor depends upon the type of organic carbonaceous solids utilized, the composition of the fluidizing gas, and the temperature of the fluidized bed.

Carbonized organic solids may be removed from near the top of the fluidized bed after they have undergone carbonization. Fluidizing gas may be removed from the fluidized bed contactor and used to pneumatically transport the carbonized solids to the heat exchanger wherein the hot carbonized solids are cooled by preheating incoming organic carbonaceous solids prior to carbonizing.

Carbonized solids, after passing through the heat exchanger, are conveyed to a solids/gas separator, and separated carbonized organic solids are conveyed to a flash tank wherein the solids system is depressurized. Separated gases may be conveyed to compressors, pressurized, and recirculated to the incoming organic carbonaceous material stream to the heat exchanger to provide pneumatic transport of solids through the system.

Carbonized organic solids are transferred from the flash tank to drainage means whereby excess moisture, including condensed steam, may be removed simply by draining. After draining, carbonized organic solids are mechanically dewatered by means of screening, pressing, filtering, or the like, to provide a product of less than 50 weight percent moisture, and preferably less than 40 weight percent moisture.

The dry, carbonized organic solid products are suitable for use as a superior fuel, or as an intermediate material for further conversion. The product organic solids produced by the process of this invention are dewatered principally by mechanical means and are chemically upgraded during carbonization. Water removed during mechanical dewatering contains low levels of organic contaminants, and may be recirculated for steam generation. Circulating gas and steam sufficient to insure that circulating and fluidizing gas is saturated after heating is transferred through a blower for recirculation to the system.

BRIEF DESCRIPTION OF THE DRAWING

The above mentioned and other features of this invention, and the manner of obtaining them, will become more apparent, and the invention will be best understood by reference to the following description of preferred embodiments of the invention read in conjunction with the accompanying drawing showing a highly schematic flow diagram of one embodiment of the process of this invention.

DESCRIPTION OF THE PREFERRED EMBODIMENTS

As shown in the drawing, high moisture content organic carbonaceous feed is delivered through feed delivery conduit 11 to mechanical dewatering means 10. Suitable high moisture content organic carbonaceous feed material may include peat, lignite, kelp, bagasse, mulch, municipal sludge, other biomass and organic waste materials, and mixtures thereof. Organic carbonaceous feed materials may require preliminary size reduction treatment, such as grinding, cutting or chopping, to provide organic carbonaceous feed material of a size suitable for mechanical dewatering and fluidized bed treatment. Mechanical pressing, screening, filtering apparatus, or other mechanical dewatering means, may be used for mechanical dewatering means 10. Moisture removed from feed solids is discharged through discharge conduit 12. Discharged water may be processed for steam generation or may be conveyed for disposal.

Mechanically dewatered organic solids are conveyed through conduit 13 to a solids pressure feed system. A lockhopper system, screw feeder, or any pressurized feeding system may be employed. The lockhopper system shown in the figure comprises first lockhopper 14, solids conduit 15, pressure valve 16, second lockhopper 17, pressurized solids conduit 18 and pressure/flow regulator 19. A variety of solids pressure feeding systems may be adapted for use in this process for feeding organic solids to a pressurized system of about 300 to about 600 psia.

Mechanically dewatered organic carbonaceous feed solids are pneumatically transported through conduit 21 to feed preheat indirect heat exchanger 22. In heat exchanger 22, mechanically dewatered organic carbonaceous solids feed which enters at about ambient temperature passes countercurrently to hot carbonized product solids and gases, and heat is exchanged indirectly, cooling the carbonized product and preheating the mechanically dewatered organic carbonaceous feed solids. The dewatered organic carbonaceous feed solids may preferably be preheated in heat exchanger 22 to temperatures of about 330° to about 370° F. Heat exchanger 22 may comprise any suitable indirect heat exchanger, such as a shell-and-tube exchanger, and is preferably operated in a countercurrent fashion.

Mechanically dewatered and preheated carbonaceous solids are pneumatically transported by the circulating gas throughout this process, as opposed to the generally used aqueous slurry transport of the prior art. Suitable transport gas streams may comprise a mixture of carbon dioxide and steam, or any other gas or mixture of gases in which organic solids remain suspended, and which will not react adversely with the solids being treated.

Mechanically dewatered and preheated organic carbonaceous solids are pneumatically transported through conduit 24 to solids/gas separator 25, wherein solids and gases are separated. Suitable solids/gas separators are known to the art, such as cyclonic separators. Separated, mechanically dewatered, and preheated solids are discharged from separator 25, and delivered through conduit 27 to a central portion of fluidized bed carbonization zone 31. Gases separated in separator 25 are conveyed through conduit 26 to heater 28 where they are heated to temperatures of about 670° to about 730° F., preferably about 690° to about 710° F., for example, when peat is utilized as organic carbonaceous feed material. The desired temperature of the gas depends upon the composition of the carbonaceous organic solids being treated. Other heating means may be used to heat the solids fluidized bed carbonization zone 31 to the desired temperature, such as any heating means within the fluidized bed itself.

Heated circulating gases serve as fluidizing gases in fluidized bed contactor 30, and are introduced below fluidized bed support means 32, or other suitable means to evenly disperse and distribute the fluidizing gases. The gas flow is sufficient to maintain the organic solids in fluidized condition in the fluidized bed where they undergo carbonization. Carbonization zone 31 comprises a fluidized bed zone wherein carbonization of mechanically dewatered preheated carbonaceous organic solids occurs. Solids residence times of about 1 minute to about 30 minutes are sufficient to carbonize the mechanically dewatered preheated carbonaceous organic solids, the required residence times depending upon the temperature of the fluidized bed and the nature of the organic solids. Suitable solids temperatures in the fluidized bed carbonization zone are about 300° F. to about 500° F. Preferred solids temperatures are about 350° F. to about 400° F., dependent upon the type of organic carbonaceous feed material used. Suitable times and solids temperatures for specific process conditions and specific organic solids can be ascertained by one skilled in the art upon reading of this disclosure and experimentation within the limits herein set forth. The gas flow rate through carbonization zone 31 should be sufficient to maintain the solids in fluidized state and likewise may be readily ascertained, dependent upon the solids particle size and density. The treatment in carbonization zone 31 removes chemically bound oxygen as carbon dioxide, thereby providing higher heating value to the treated carbonaceous solids. Treatment in carbonization zone 31 also alters the structure of the carbonaceous solids being treated, enhancing a second mechanical dewatering.

Carbonized solids are withdrawn by overflow from the top of fluidized bed 31 into carbonized solids removal conduit 33. Fluidizing gas is removed from the headspace of fluidized bed contactor 30 through gas removal conduit 34. The removed fluidizing gas is combined with carbonized solids for pneumatic conveyance of the solids/gas mixture through carbonized solids/gas conduit 35 to indirect heat exchanger 22. The combined solids/gas stream generally has a temperature of about 350° F. to about 400° F. Hot carbonized solids and gas preferably pass countercurrently to mechanically dewatered feed organic carbonaceous solids and circulating gas, which enter the heat exchanger at ambient temperatures. As a result of countercurrent heat exchange, incoming solid carbonaceous organic feed attains a temperature of about 330° F. to about 370° F. and carbonized organic solids are cooled to below about 140° F.

Cooled carbonized solids and conveyance gas are discharged from heat exchanger 22 through conduit 36 and conveyed to solids/gas separator 37. Solids/gas separator 37 may be any suitable solids/gas separator, such as a cyclonic separator. A large portion of the free conveyance gas is removed from solids/gas separator 37 through gas conduit 38 and is recirculated. Compressor 41 repressurizes the gas to desired pressure for recycle through conduit 42 to the pneumatic transport system. Repressurized gas streams may be recirculated through gas recycle conduit 42 to provide pneumatic transport and fluidizing gas for the carbonization and dewatering process.

Carbonized organic solids separated in solids/gas separator 37 are depressurized through valved carbonized solids conduit 43 and conveyed to flash tank 44. Any suitable depressurization means may be used. Carbonized solids are discharged from flash tank 44 through conduit 46 and passed through drainage means 47. Substantial amounts of excess moisture, particularly condensed steam, may be removed from carbonized solids by simple drainage means and removed through conduit 51.

Gas released from flash tank 44 is conveyed to compressor 41A through conduit 45 and recirculated through gas recirculation conduit 42. Excess gas, primarily carbon dioxide, produced by the carbonization reaction in fluidized bed contactor 30 may be discharged through conduit 39 as necessary to maintain a suitable circulating gas composition. Drained carbonized solids undergo further mechanical dewatering in mechanical dewatering means 48. Mechanical pressing, screening, filtering apparatus, or other mechanical dewatering means may be used for mechanical dewatering means 48. Dry, carbonized organic solid product is withdrawn through product conduit 49 and is suitable for use as fuel with less than about 50 weight percent, and preferably less than about 40 weight percent moisture. Dry carbonized organic solids product provides a superior fuel or raw material for conversion. Liquid is removed from mechanical dewatering means 48 through water removal conduit 50, and may be recirculated for steam regeneration, or utilized for other productive purposes.

The process of this invention is a "dry" process with conveyance of solids in a pneumatic stream as opposed to the "wet" slurry conveyance processes of the prior art. The dry process of this invention greatly reduces the energy load requirements and reduces leaching of desirable organic components from the organic carbonaceous feed by liquids. In the process of this invention, the major portion of the moisture is removed from the solids by the mechanical dewatering steps, because the pressurized system restrains water removal by vaporization. Further, the carbonization modifies the organic solids in a manner which facilitates water removal in a mechanical dewatering step following carbonization resulting in a solids product comprising less than 50 weight percent and preferably less than 40 weight percent water.

The following example sets forth specific materials and embodiments in detail and is meant to exemplify the invention only and not to limit it in any way.

EXAMPLE

Raw peat comprising 20 pounds peat solids and 200 pounds water is treated according to the process shown schematically in the Figure. The raw peat feed is pressed mechanically to liberate 120 pounds water which is withdrawn from the system. The remaining 20 pounds peat solids and 80 pounds water is pressurized through a lockhopper system to about 500 psia and ambient temperature. Conveyance gas comprising 100 pounds carbon dioxide and 0.14 pounds steam pneumatically conveys the solids to a shell-and-tube heat exchanger to countercurrently preheat the mechanically dewatered peat to 350° F. Preheated feed solids are separated from the preheated gases and the preheated solids are passed to a fluidized bed contactor. Separated gases are heated to approximately 694° F. and introduced below the support grid of the fluidized bed reactor to provide fluidizing gas. Solids are carbonized in the fluidized bed by retention for about 15 minutes. During carbonization, 4 pounds of carbon dioxide is generated and approximately 9.9 pounds of water is evaporated from the peat solids.

Sixteen pounds of carbonized peat solids are withdrawn from the fluidized bed reactor separately from the fluidizing gas and then recombined to form a saturated stream having a temperature of 375° F. at 500 psia and comprising 16 pounds peat solids, 55.14 pounds peat water, 25 pounds steam and 104 pounds carbon dioxide. The combined stream is passed countercurrently through the heat exchanger in thermal exchange relation with incoming peat feed and is cooled to about 120° F. Cooled carbonized peat and conveyance gas are separated and recirculating gas comprising 100 pounds carbon dioxide and 0.14 pound moisture is conveyed for compression, with about 4 percent $CO_2$ purge from the system. Carbonized peat comprising about 16 pounds peat and 80 pounds water is withdrawn from the flash tank, and drained of 15 pounds water. The drained carbonized peat is mechanically pressed removing 57 pounds of water to yield carbonized peat product comprising 16 pounds peat solids and 8 pounds water. Thus, raw peat containing 90 percent water is converted, by the process of this invention, to carbonized peat product comprising only 33 percent water which is suitable for direct energy conversion processes or further processing.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for beneficiating, dewatering and carbonizing high moisture content carbonaceous solids comprising the steps of:

introducing said carbonaceous solids having a moisture content of about 75 weight percent and less through a pressure feeding means to a pressurized pneumatic transport stream;

passing said carbonaceous solids in said pneumatic transport stream to a first solids/gas separation means;

separating said carbonaceous solids from the gas comprising said pneumatic transport stream and passing said separated carbonaceous solids to a fluidized bed carbonization zone within a fluidized bed contactor and passing separated gas comprising said pneumatic transport stream to said fluidized bed to provide fluidizing gas;

carbonizing said carbonaceous solids in said fluidized bed at elevated temperatures producing carbonized solids;

withdrawing said carbonized solids and said fluidizing gas from said fluidized bed contactor;

conveying said carbonized solids in said pneumatic transport stream comprising said fluidizing gas to a second solids/gas separation means, separating said carbonized solids from said conveyed pneumatic transport stream comprising said fluidizing gas and recycling separated gas from said second solids/gas separation means to said pneumatic transport stream upstream of said first solids/gas separation means; and passing said carbonized solids separated in said second solids/gas separation means to a mechanical dewatering means and mechanically dewatering said carbonized solids in said mechanical dewatering means so as to produce beneficiated, dewatered, carbonized solids product.

2. A process according to claim 1, wherein said carbonaceous solids are conveyed in said pressurized pneumatic transport stream to a preheating means, and said carbonaceous solids are therein preheated prior to conveyance to said first solids/gas separation means.

3. A process according to claim 2, wherein said preheating means comprises an indirect countercurrent heat exchange means whereby said carbonaceous solids in said pneumatic transport stream are passed in indirect countercurrent heat exchange relationship to hot, carbonized solids withdrawn from said fluidized bed contactor.

4. A process according to claim 3, wherein said preheating means comprises a shell-and-tube heat exchanger.

5. A process according to claim 3, wherein said carbonaceous feed solids are preheated to about 300° to about 400° F. in said countercurrent heat exchange means.

6. A process according to claim 1, wherein a portion of said separated gas from said second solids/gas separation means is separated from said pneumatic transport stream prior to introduction of said carbonaceous solids.

7. A process according to claim 1, wherein said pneumatic transport stream is maintained at a pressure of about 300 to about 600 psia.

8. A process according to claim 1, wherein said pneumatic transport stream comprises a mixture of pressurized carbon dioxide and steam.

9. A process according to claim 1, wherein said gas separated in said first solids/gas separation means is conveyed to a heater wherein said gas is heated to about 670° to about 730° F., and said gas is then introduced into said fluidized bed contactor to provide heating and said fluidizing gas.

10. A process according to claim 1, wherein said carbonaceous solids are retained in said fluidized bed contactor for a residence time of about 1 minute to about 30 minutes.

11. A process according to claim 1, wherein said carbonized solids separated in said second solids/gas separation means are depressurized in a flash tank prior to said mechanical dewatering means.

12. A process according to claim 11, wherein said carbonized solids are separated from excess gas in said flash tank and said excess gas released in said flash tank is conveyed to a compressor, repressurized, and recycled to said pneumatic transport stream.

13. A process according to claim 12, wherein said excess gas comprises primarily carbon dioxide and said carbon dioxide is discharged from the system prior to repressurization to maintain a suitable circulating gas composition.

14. A process according to claim 1, wherein said carbonized solids separated in said second solids/gas separation measn are drained prior to mechanical dewatering.

15. A process according to claim 1, wherein said carbonized solids are mechanically dewatered in said mechanical dewatering means to an extent producing said beneficiated, dewatered, carbonized solids product comprising less than about 50 weight percent moisture.

16. A process according to claim 1, wherein said carbonized solids are mechanically dewatered in said mechanical dewatering means to an extent producing said beneficiated, dewatered, carbonized solids product comprising less than about 40 weight percent moisture.

17. A process according to claim 1, wherein carbonaceous solids are carbonized in said fluidized bed at temperatures of about 300° to about 500° F.

18. A process for beneficiating, dewatering and carbonizing high moisture content carbonaceous solids comprising the steps of:

mechanically dewatering said high moisture content carbonaceous solids having a moisture content in excess of about 75 weight percent so as to reduce said moisture content of said carbonaceous solids to about 75 weight percent and less;

introducing said carbonaceous solids having a moisture content of about 75 weight percent and less through a pressure feeding means to a pressurized pneumatic transport stream;

passing said carbonaceous solids in said pneumatic transport stream to a first solids/gas separation means;

separating said carbonaceous solids from the gas comprising said pneumatic transport stream and passing said separated carbonaceous solids to a fluidized bed carbonization zone within a fluidized bed contactor and passing separated gas comprising said pneumatic transport stream to said fluidized bed to provide fluidizing gas;

carbonizing said carbonaceous solids in said fluidized bed at elevated temperatures producing carbonized solids;

withdrawing said carbonized solids and said fluidizing gas from said fluidized bed contactor;

conveying said carbonized solids in said pneumatic transport stream comprising said fluidizing gas to a second solids/gas separation means, separating said carbonized solids from said conveyed pneumatic transport stream comprising said fluidizing gas and recycling separated gas from said second solids/gas separation means to said pneumatic transport stream upstream of said first solids/gas separation means; and passing carbonized solids separated in said second solids/gas separation means to a mechanical dewatering means and mechanically dewatering said carbonized solids in said mechanical dewatering means so as to produce beneficiated, dewatered, carbonized solids product.

* * * * *